US011421540B2

(12) United States Patent
Little

(10) Patent No.: US 11,421,540 B2
(45) Date of Patent: Aug. 23, 2022

(54) VANE ARM LOAD SPREADER

(71) Applicant: United Technologies Corporation, Farmington, CT (US)

(72) Inventor: Jonathan D. Little, West Hartford, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 80 days.

(21) Appl. No.: 16/679,448

(22) Filed: Nov. 11, 2019

(65) Prior Publication Data

US 2021/0140331 A1 May 13, 2021

(51) Int. Cl.
*F01D 9/04* (2006.01)
*F04D 29/56* (2006.01)

(52) U.S. Cl.
CPC ..... *F01D 9/041* (2013.01); *F04D 29/563* (2013.01); *F05D 2220/32* (2013.01); *F05D 2230/80* (2013.01); *F05D 2240/12* (2013.01)

(58) Field of Classification Search
CPC ... F01D 1/02; F01D 9/04; F01D 9/041; F01D 9/042; F01D 17/162; F04D 15/0038; F04D 29/002; F04D 29/0246; F04D 29/563; F05D 2240/12; F05D 2260/31
See application file for complete search history.

(56) References Cited

U.S. PATENT DOCUMENTS

| | | | | |
|---|---|---|---|---|
| 3,764,189 | A | 10/1973 | Lechner et al. | |
| 4,363,600 | A | 12/1982 | Thebert | |
| 6,209,198 | B1 | 4/2001 | Lammas et al. | |
| 8,414,248 | B2 | 4/2013 | Perez et al. | |
| 10,208,618 | B2 | 2/2019 | Gasmen et al. | |
| 2014/0219785 | A1* | 8/2014 | Gasmen | F04D 29/563 415/148 |
| 2015/0354401 | A1* | 12/2015 | Morganti | F04D 29/563 415/160 |

* cited by examiner

*Primary Examiner* — Courtney D Heinle
*Assistant Examiner* — Danielle M. Christensen
(74) *Attorney, Agent, or Firm* — Bachman & LaPointe, P.C.

(57) ABSTRACT

A vane arm connection system for a gas turbine engine, includes a vane stem having a flatted head; a vane arm having a claw engaging the flatted head; and a load spreader having a spreader body defining structure engaging the flatted head, and at least one extension extending laterally from the spreader body.

16 Claims, 8 Drawing Sheets

VANE ARM LOAD SPREADER

BACKGROUND OF THE DISCLOSURE

The present disclosure relates to gas turbine engine and, more particularly, to vane arm connection systems for gas turbine engines.

Gas turbine engines, such as those that power modern commercial and military aircraft, generally include a compressor section to pressurize an airflow, a combustor section to burn a hydrocarbon fuel in the presence of the pressurized air, and a turbine section to extract energy from the resultant combustion gases.

Some gas turbine engines include variable stator vanes that can be pivoted about their individual axes to change an operational performance characteristic of the engine. Typically, the variable stator vanes are robustly designed to handle the stress loads that are applied to change the position of the vanes. A mechanical linkage is typically utilized to rotate the variable stator vanes. Because forces on the variable stator vanes can be relatively significant, forces transmitted through the mechanical linkage can also be relatively significant. Variable vanes are mounted about a pivot and are attached to an arm that is in turn actuated to adjust each of the vanes of a stage. A specific orientation between the arm and vane is required to assure that each vane in a stage is adjusted as desired to provide the desired engine operation. Newer compressor designs have resulted in higher compression ratios and loads. Further, recent designs have more vanes distributed through roughly the same space, resulting in decreased size, especially decreased diameter, of the vane stems. The point of connection of vane arms to vane stems is also subjected to even larger forces, especially torques, during surge load operation.

Sheet metal design of vane arms are used in legacy engines and are low cost but are limited in terms of grip strength to the vane stem. Current and future compressors tend to be of higher pressure ratio, generating higher loads which are limiting to the sheet metal design of a vane arm. One possible solution to this is machined vane arms which can have greater strength, but this incurs significant cost increase and can still leave room for improvement in grip strength of the vane arm to the vane stem.

SUMMARY OF THE DISCLOSURE

In one non-limiting configuration, a vane arm connection system for a gas turbine engine, comprises a vane stem having a flatted head; a vane arm having a claw engaging the flatted head; and a load spreader having a spreader body defining structure engaging the flatted head, and at least one extension extending laterally from the spreader body.

In another non-limiting configuration, the flatted head is defined by laterally spaced flat surfaces on the vane stem, and wherein the claw defines inwardly facing edges for engaging the flat surfaces.

In a further non-limiting configuration, the at least one extension of the load spreader extends laterally substantially parallel to the laterally spaced flat surfaces of the flatted head for engaging with the inwardly facing edges of the claw.

In another non-limiting configuration, the at least one extension of the load spreader comprises two extensions extending opposite to each other.

In a further non-limiting configuration, the claw has an upper surface defining an opening for engaging the vane stem and two claw arms extending downwardly from the upper surface and engaging the flatted head, the spreader body is positioned between the upper surface and the claw arms, and the at least one extension also extends downwardly into a space between the two claw arms.

In another non-limiting configuration, the claw has an upper surface defining an opening for engaging the vane stem and two claw arms extending downwardly from the upper surface and engaging the flatted head, the spreader body is positioned below the claw arms, and the at least one extension also extends upwardly into a space between the two claw arms.

In a further non-limiting configuration, the spreader body defines a shelf extending radially outwardly from the vane stem, wherein the claw arms are held against disengaging from the vane stem.

In another non-limiting configuration, the spreader body defines a spacer between the claw arms and a shoulder of the vane stem.

In a further non-limiting configuration, the spreader body defines a spacer between the claw arms and a bushing within which the vane stem is positioned.

In another non-limiting configuration, the laterally spaced flat surfaces on the vane stem are spaced from each other at a first width, and wherein the at least one extension defines oppositely facing parallel surfaces which are spaced at a second width, wherein the second width is less than the first width so that, under non-loaded conditions, the claw engages the flatted head and not the extension.

In still another non-limiting configuration, the load spreader comprises stamped and formed sheet metal defining the spreader body and the at least one extension.

In a still further non-limiting configuration, the spreader body has an opening which matches a shape of the flatted head, and downwardly curved ends defining the at least one extension.

In another non-limiting configuration, the spreader body has a first opening which matches a shape of the flatted head, upwardly curving ends defining the at least one extension, and a further spreader body portion extending from the at least one extension and defining a second opening for engaging the vane stem.

In a further non-limiting configuration, a method for retrofitting a vane arm having a vane arm claw to a vane stem having a flatted head, wherein the vane arm claw comprises claw arms for engaging the flatted head, comprises the step of positioning a load spreader on the vane stem, the load spreader comprising a spreader body defining structure engaging the flatted head, and at least one extension extending laterally from the spreader body, wherein the positioning step engages the spreader body with the flatted head.

In a still further non-limiting configuration, the vane arm claw is pre-loaded to contact with the flatted head, and spaced from contact with the at least one extension.

BRIEF DESCRIPTION OF THE DRAWINGS

A detailed description of non-limiting embodiments of the disclosure follows, with reference to the attached drawings, wherein.

DETAILED DESCRIPTION

Figure 1:
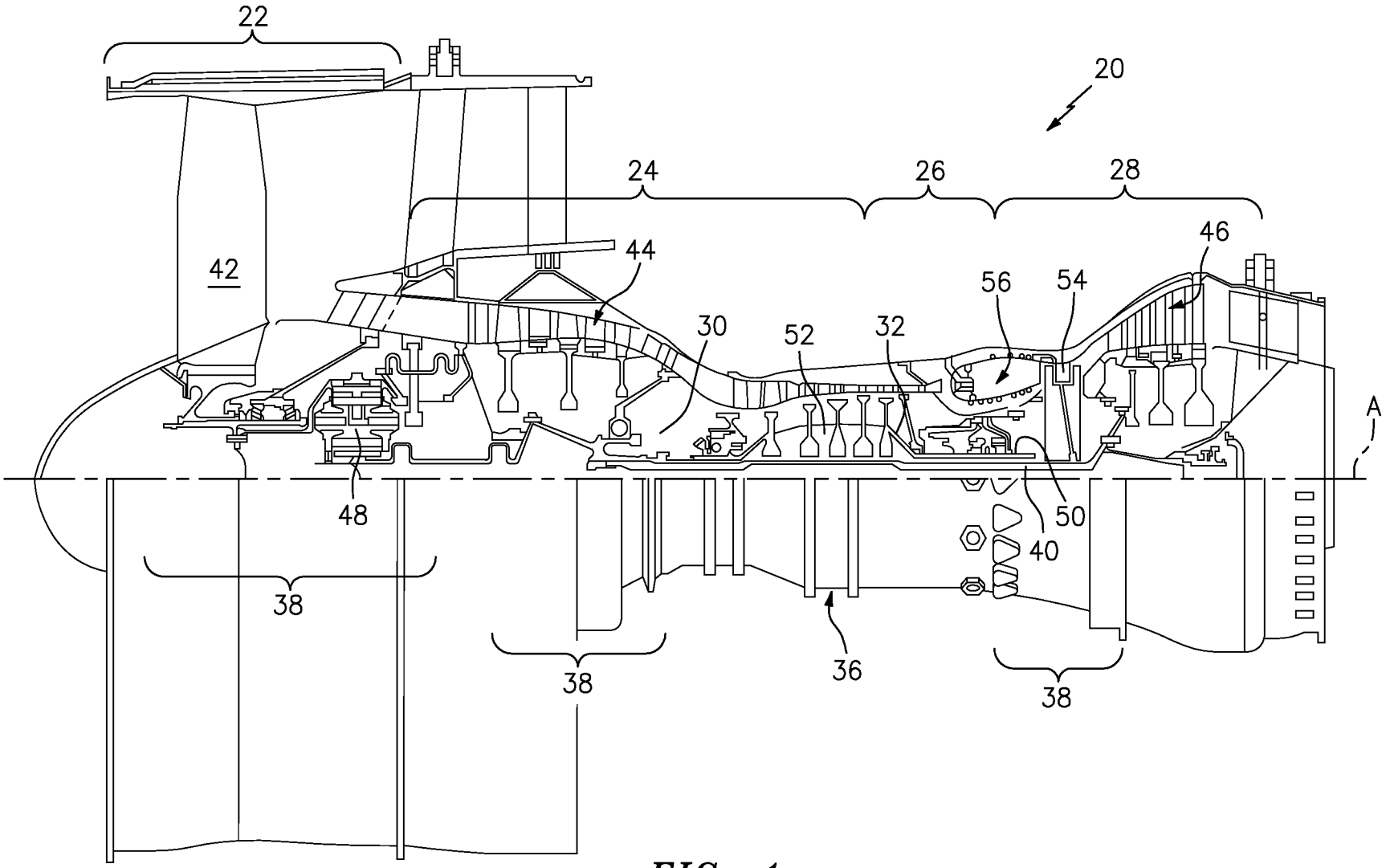
FIG. 1 is a schematic cross-section of a non-limiting example of a gas turbine engine architecture.

FIG. 1 schematically illustrates a gas turbine engine 20. The gas turbine engine 20 is disclosed herein as a two-spool GTF (geared turbofan) that generally incorporates a fan section 22, a compressor section 24, a combustor section 26 and a turbine section 28. Alternative engine architectures might include other systems or features. The fan section 22 drives air along a bypass flowpath while the compressor section 24 drives air along a core flowpath for compression and communication into the combustor section 26 then expansion through the turbine section 28. Although depicted as a GTF in the disclosed non-limiting embodiment, it should be understood that the concepts described herein are not limited to use with GTF as the teachings may be applied to other types of turbine engines such as a direct drive turbofan with high, or low, bypass turbofan, turbojets, turboshafts, and three spool (plus fan) turbofans wherein an intermediate spool includes an intermediate pressure compressor ("IPC") between a Low Pressure Compressor ("LPC") and a High Pressure Compressor ("HPC"), and an intermediate pressure turbine ("IPT") between the high pressure turbine ("HPT") and the Low pressure Turbine ("LPT").

The engine 20 generally includes a low spool 30 and a high spool 32 mounted for rotation about an engine central longitudinal axis A relative to an engine static structure 36 via several bearing compartments 38. The low spool 30 generally includes an inner shaft 40 that interconnects a fan 42, a low pressure compressor 44 ("LPC") and a low pressure turbine 46 ("LPT"). The inner shaft 40 drives the fan 42 directly or thru a geared architecture 48 to drive the fan 42 at a lower speed than the low spool 30. An exemplary reduction transmission is an epicyclic transmission, namely a planetary or star gear system.

The high spool 32 includes an outer shaft 50 that interconnects a high pressure compressor 52 ("HPC") and high pressure turbine 54 ("HPT"). A combustor 56 is arranged between the HPC 52 and the HPT 54. The inner shaft 40 and the outer shaft 50 are concentric and rotate about the engine central longitudinal axis A which is collinear with their longitudinal axes.

Core airflow is compressed by the LPC 44 then the HPC 52, mixed with fuel and burned in the combustor 56, then expanded over the HPT 54 and the LPT 46. The turbines 54, 46 rotationally drive the respective low spool 30 and high spool 32 in response to the expansion. The main engine shafts 40, 50 are supported at a plurality of points by the bearing compartments 38. It should be understood that various bearing compartments 38 at various locations may alternatively or additionally be provided.

In one example, the gas turbine engine 20 is a high-bypass geared aircraft engine with a bypass ratio greater than about six (6:1). The geared architecture 48 can include an epicyclic gear train, such as a planetary gear system or other gear system. The example epicyclic gear train has a gear reduction ratio of greater than about 2.3:1, and in another example is greater than about 3.0:1. The geared turbofan enables operation of the low spool 30 at higher speeds which can increase the operational efficiency of the LPC 44 and LPT 46 to render increased pressure in relatively few stages.

A pressure ratio associated with the LPT 46 is pressure measured prior to the inlet of the LPT 46 as related to the pressure at the outlet of the LPT 46 prior to an exhaust nozzle of the gas turbine engine 20. In one non-limiting embodiment, the bypass ratio of the gas turbine engine 20 is greater than about ten (10:1), the fan diameter is significantly larger than that of the LPC 44, and the LPT 46 has a pressure ratio that is greater than about five (5:1). It should be understood, however, that the above parameters are only exemplary of one embodiment of a geared architecture engine and that the present disclosure is applicable to other gas turbine engines including direct drive turbofans, where the rotational speed of the fan 42 is the same (1:1) of the LPC 44.

In one example, a significant amount of thrust is provided by the bypass flow path due to the high bypass ratio. The fan section 22 of the gas turbine engine 20 is designed for a particular flight condition—typically cruise at about 0.8 Mach and about 35,000 feet (10668 meters). This flight condition, with the gas turbine engine 20 at its best fuel consumption, is also known as bucket cruise Thrust Specific Fuel Consumption (TSFC). TSFC is an industry standard parameter of fuel consumption per unit of thrust.

Fan pressure ratio is the pressure ratio across a blade of the fan section 22 without the use of a fan exit guide vane system. The relatively low fan pressure ratio according to one example of a gas turbine engine 20 is less than 1.45. Low corrected fan tip speed is the actual fan tip speed divided by an industry standard temperature correction of ("T"/518.7)0.5 in which "T" represents the ambient temperature in degrees Rankine. The low corrected fan tip speed according to one example of a gas turbine engine 20 is less than about 1150 fps (351 m/s).

Figure 2:
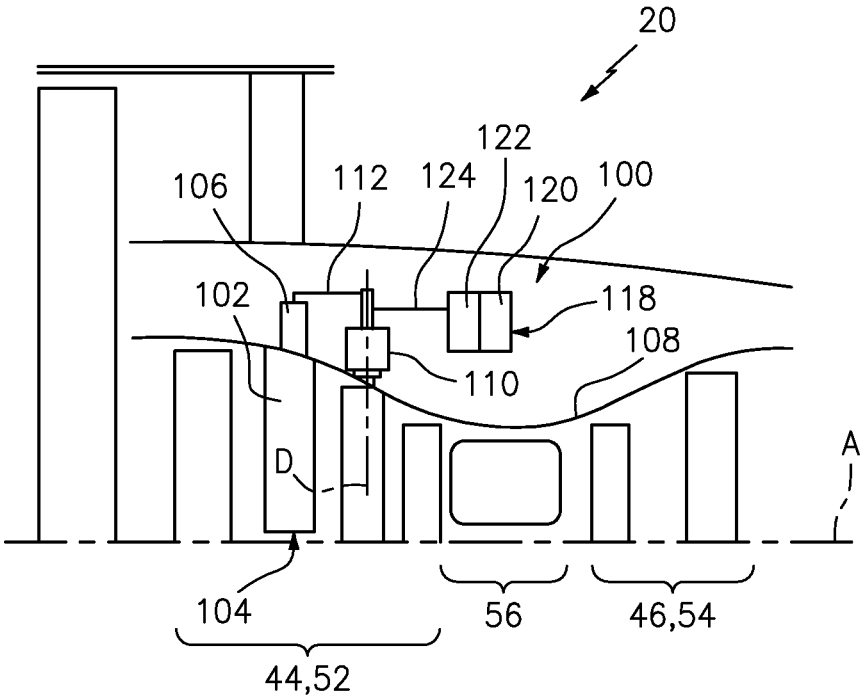
FIG. 2 is a schematic view of a variable vane system for a gas turbine engine.

With reference to FIG. 2, one or more stages of the LPC 44 and/or the HPC 52 include a variable vane system 100 that can be rotated to change an operational performance characteristic of the gas turbine engine 20 for different operating conditions. The variable vane system 100 may include one or more variable vane stages.

Figure 3:
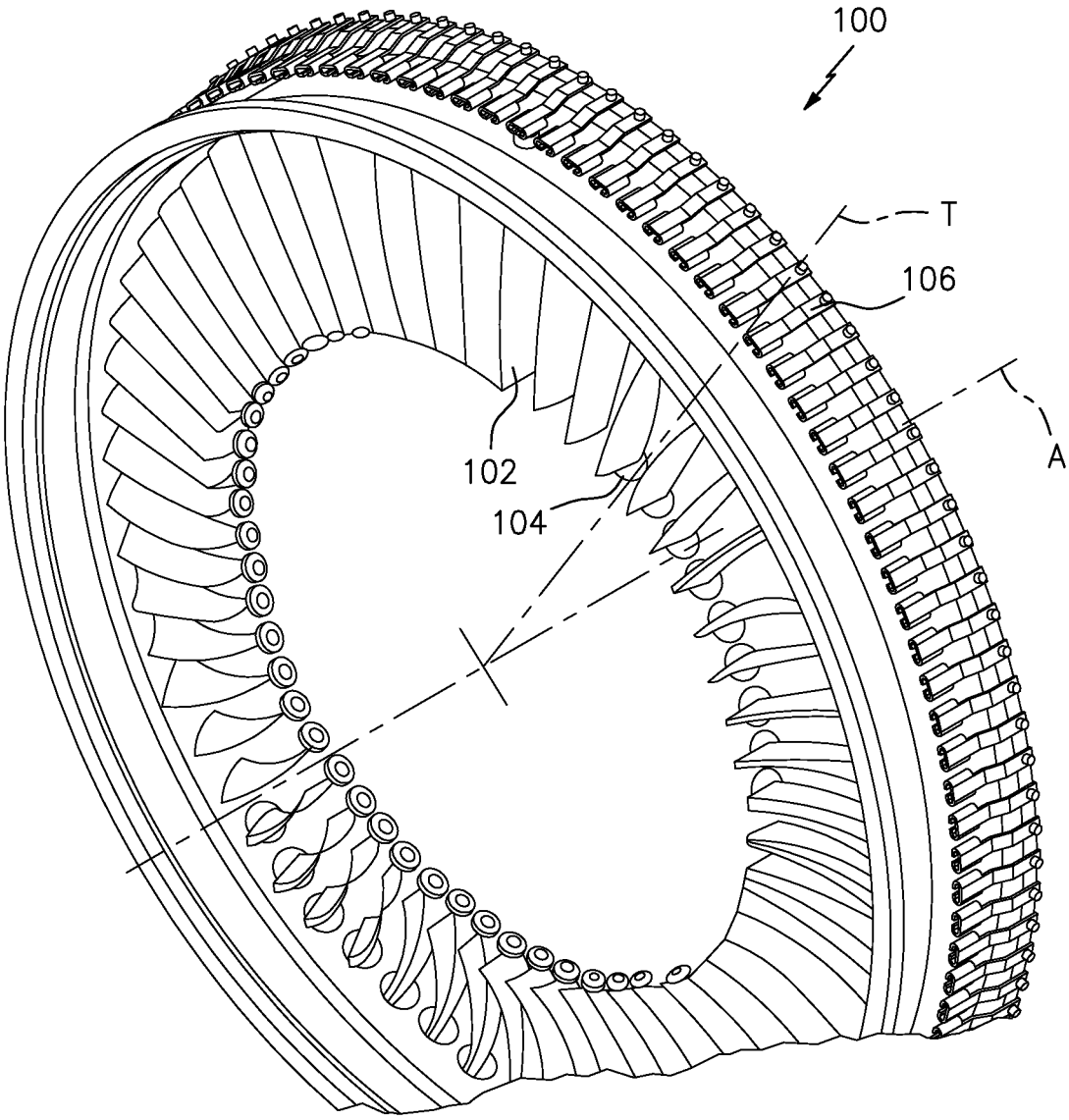
FIG. 3 is a partial perspective view of one stage of a variable vane system for a gas turbine engine.

The variable vane system 100 may include a plurality of variable stator vanes 102 (see also FIG. 3) circumferentially arranged around the engine central axis A. The variable stator vanes 102 each include a variable vane body that has an airfoil portion such that one side of the airfoil portion generally operates as a suction side and the opposing side of the airfoil portion generally operates as a pressure side. Each of the variable stator vanes 102 generally spans between an inner diameter and an outer diameter relative to the engine central axis A.

Figure 4:
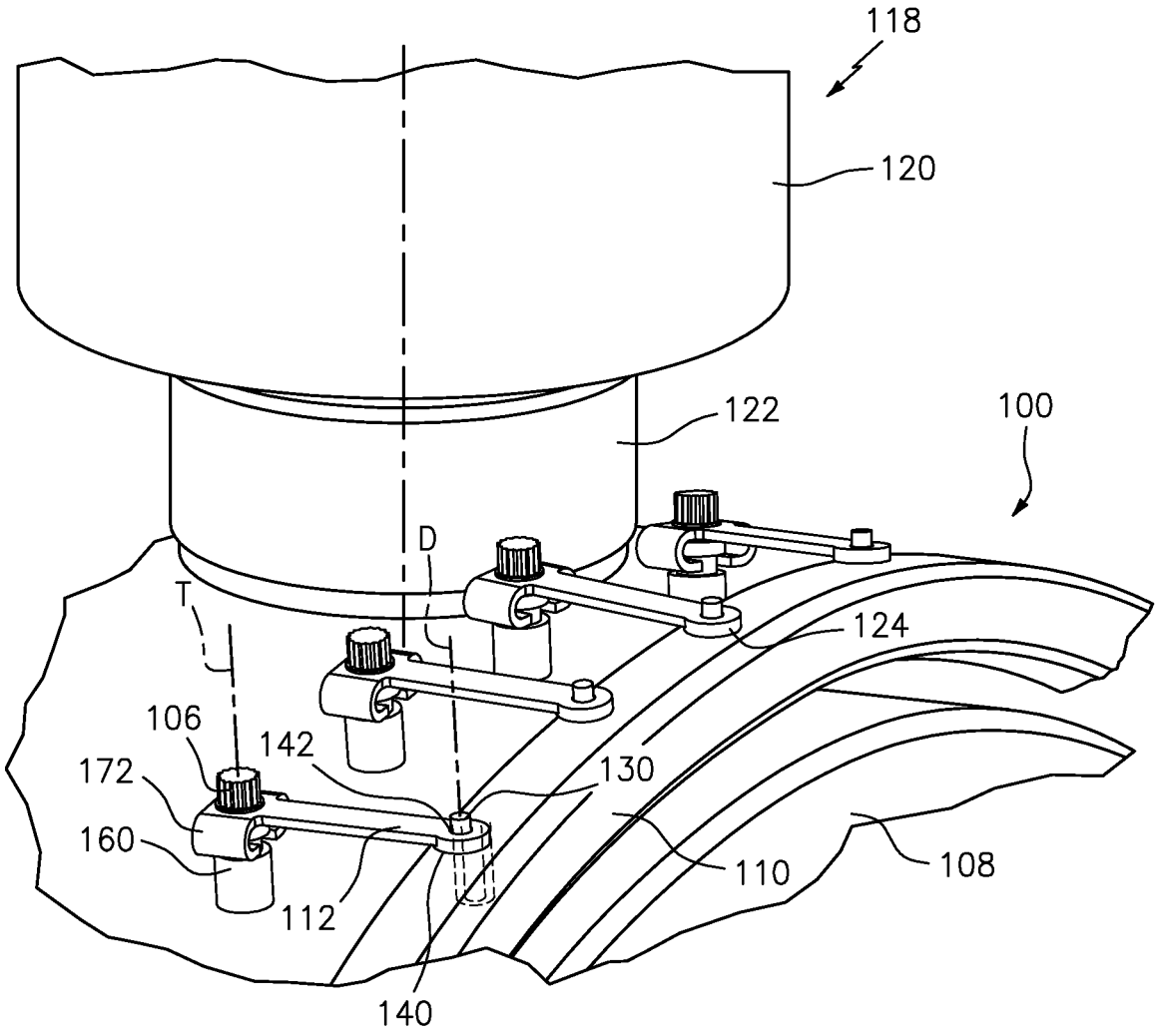
FIG. 4 is a partial perspective view of a variable vane system for a gas turbine engine according to one disclosed non-limiting embodiment.

Each of the variable stator vanes 102 includes an inner trunion 104 that is receivable into a corresponding socket and an outer trunion 106 mounted through an outer engine case 108 such that each of the variable stator vanes 102 can pivot about a vane axis T (shown in FIG. 4).

The variable vane system 100 further includes a synchronizing ring assembly 110 to which, in one disclosed non-limiting embodiment, each of the outer trunions 106 are attached through a vane arm 112 along a respective axis D. It should be appreciated that although a particular vane arm 112 is disclosed in this embodiment, various linkages of various geometries may be utilized.

The variable vane system 100 is driven by an actuator system 118 with an actuator 120, a drive 122 and an actuator arm 124 (also shown in FIG. 4). Although particular components are separately described, it should be appreciated that alternative or additional components may be provided.

With reference to FIG. 4, the vane arm 112 links each outer trunion 106 to the synchronizing ring assembly 110. Rotation of the synchronizing ring assembly 110 about the engine axis A (FIG. 1) drives the vane arm 112 to rotate the outer trunion 106 of each of the variable stator vanes 102.

Each vane arm 112 interfaces with the synchronizing ring assembly 110 via a pin 130. The pin 130 is swaged to an end section 140 of the vane arm 112 within an aperture 142.

FIG. 4 shows that vane arms 112 engage with vane stems 160. This point of engaging is subject to potentially significant torque during operation of the engine and also the system to position the vanes as desired. Under surge loads, this torque is increased even further.

Figure 5A:
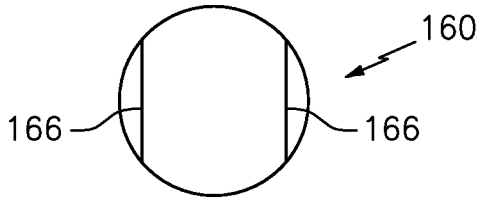
FIGS. 5A-5C illustrate a known vane arm connection to a vane stem.
Figure 5B:
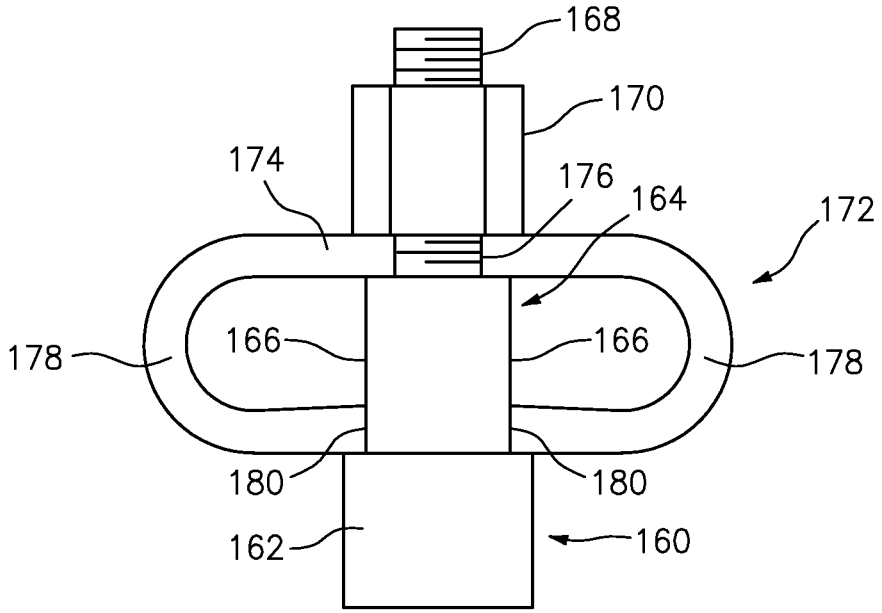
Figure 5C:
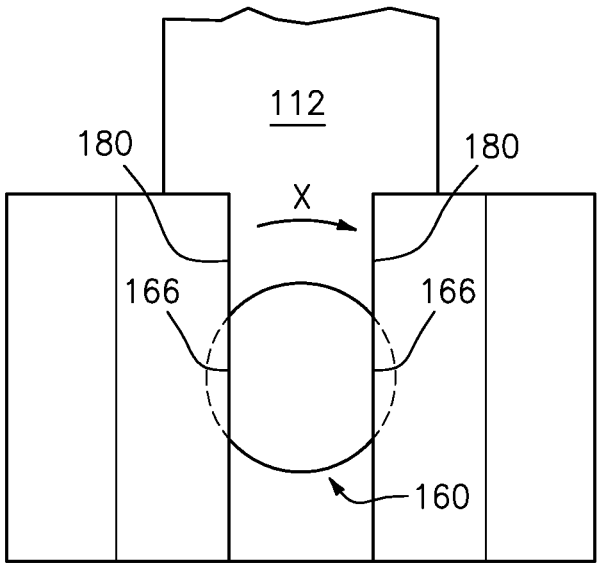

FIGS. 5A-C illustrate engagement of a known vane arm and claw structure with a vane stem. As shown, vane stem 160 can have a base 162 which extends to other systems of the engine, for example to vanes which are to be positioned around axis T as discussed above. Extending from base 162 is a flatted head 164 which defines two oppositely facing flat surfaces 166. A typical vane stem 160 then also has a round portion 168 extending upwardly from the flatted head 164, and the vane arm can be secured to the vane stem with a nut 170 which can, for example, be threaded to the round portion 168.

Also as illustrated, a typical claw structure 172 (see also FIG. 4) has a central portion 174 which has an opening 176 for receiving round portion 168 of vane stem 160. Claw arms 178 extend from central portion 174 and typically curve downwardly to define spaced, inwardly directed surfaces 180 which engage with surfaces 166 of flatted head 164. In this way, claw structure 172 is engaged with vane stem 160. As set forth above, however, current and planned designs of gas turbine engines involve use of more vanes and therefor more vane stems, which results in the need for smaller diameter vane stems. This, in turn, results in smaller flatted surfaces 166 to be engaged by inwardly directed surfaces 180, and therefore an increased chance that inwardly directed surfaces 180 will deflect relative to flat surfaces 166, particularly under surge load conditions wherein the torque (see arrow X, FIG. 5C) is significantly increased.

Figure 6:
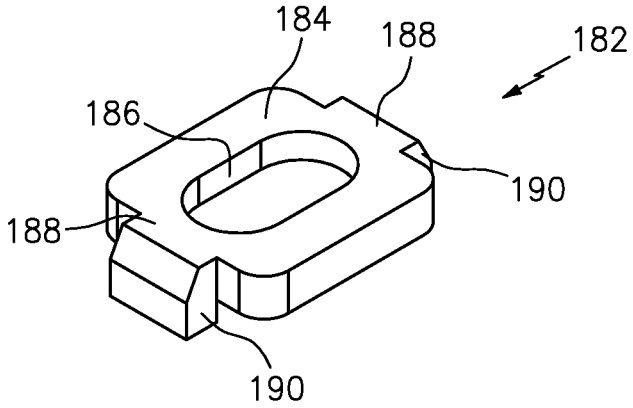
FIG. 6 shows a non-limiting embodiment of a load spreader according to the disclosure.

FIG. 6 illustrates a non-limiting configuration of a load spreader 182. In this configuration, load spreader 182 has a spreader body 184 defining an opening 186 for engaging with flat surfaces 166 of flatted head 164. Load spreader 182 has at least one, in this configuration two, extensions 188 which extend laterally from spreader body 184 and define surfaces 190 which, when load spreader 182 is mounted on a vane stem 160, extend laterally substantially parallel to flat surfaces 166 of flatted head 164. The direction of extension of extensions 188 includes at least a component which is substantially perpendicular to vane stem 160, such that the extensions define surfaces 190 extending laterally away from flat surfaces 166 of flatted head 164. While even only one extension 188 would add surface area or contact distance to help spread load during surge operation, it is noted that two opposed extensions as shown in the drawings further expands the surface area and thereby spreads load, and also does so in a way which maintains balance of the torque around the axis of rotation of vane stem 160. As will be further discussed below, these flat surfaces 166 engage with surfaces 180 of claw structure 172 under loads such as surge loads, and serve to spread the force generated by high torques over a greater distance.

Figure 7:
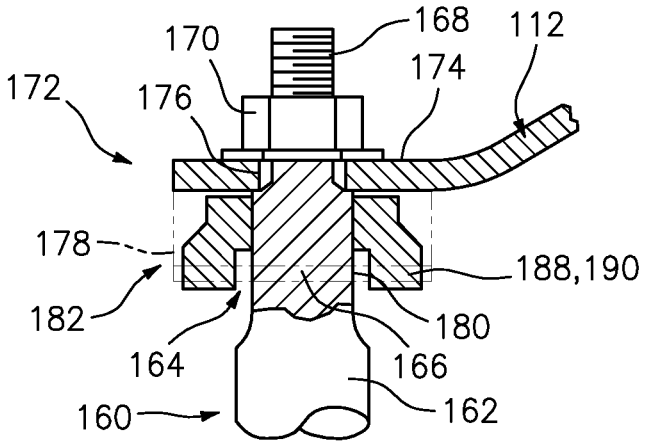
FIG. 7 is a cross section showing mounting of the load spreader of FIG. 6 in a vane arm system.

As shown, central opening 186 has a shape which substantially matches the shape of flatted head 164. Further, spreader body 184 must be sufficiently small and dimensioned to fit within the curve of claw arms 178 when in position. FIG. 7 shows a spreader 182 in position on a vane stem 160, with a portion of claw 172 sectioned away to show better detail. As shown, extensions 188 extend laterally, and also vertically, into the gap between inwardly directed surfaces 180 to present additional surface area against which surfaces 180 can contact when subjected to a high torque. Force or load is now spread over not only flat surfaces 166 of flatted head 164, but also over surfaces 190 of extensions 188.

Figure 8:
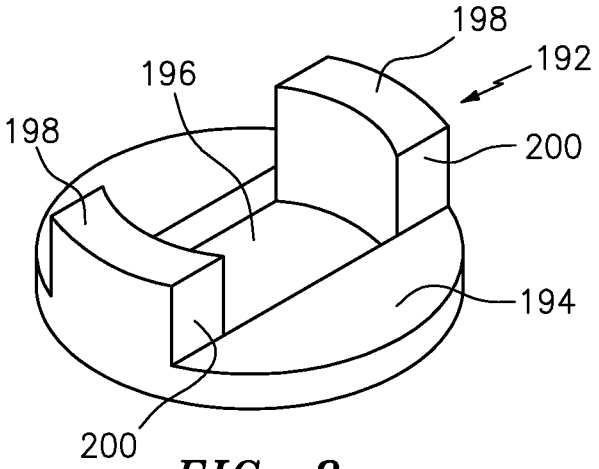
FIG. 8 shows a further non-limiting embodiment of a load spreader according to the disclosure.
Figure 9:
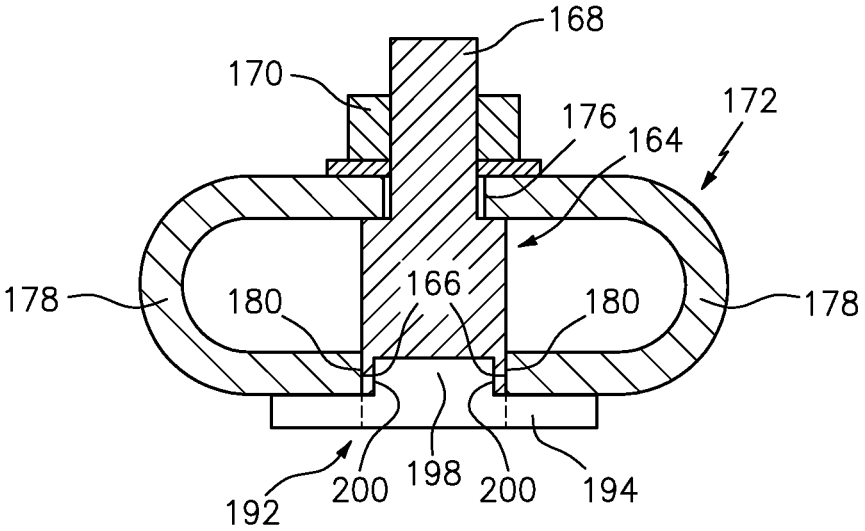
FIG. 9 is a cross section showing mounting of the load spreader of FIG. 8 in a vane arm system.

FIGS. 8 and 9 illustrate another non-limiting configuration of a load spreader 192 wherein spreader body 194 is configured to mount beneath claw arms 178. Therefore, spreader body 194 has an opening 196 which is configured to engage with flatted head 164 of vane stem 160. Extensions 198 in this configuration extend upwardly from spreader body 194 and define surfaces 200 which laterally expand the surface against which surfaces 180 of claw arms 178 can engage, for example during surge loads, to spread load due to torque in such operations. Further, in this configuration, the spreader is constrained beneath the claw and not subject to looseness and wear due to vibration.

It can be seen in FIG. 9 that during non surge load operation, surfaces 180 of claw structure 172 engage against flat surfaces 166 of flatted head 164 of vane stem 160. FIG. 9 shows a small gap between surfaces 180 of claw arms 178 and surfaces 200 of spreader 192. Under surge load conditions, this small gap is closed and load due to torque is thereby spread over surfaces 200 of spreader 192 as desired. During non-surge operation, on the other hand, contact from claw structure 172 is limited to flat surfaces 166 to maintain design operating parameters.

Figure 10:
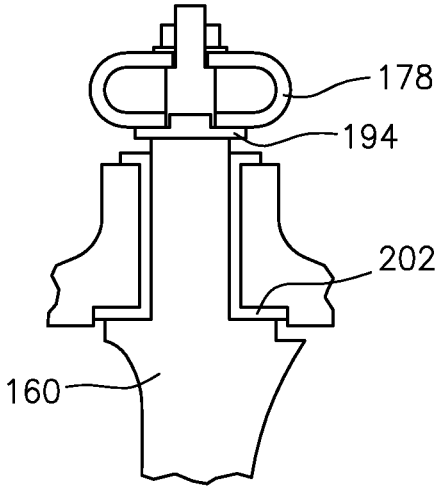
FIG. 10 is a further cross section showing mounting of the load spreader of FIG. 8 in a vane arm system.

FIG. 10 illustrates a further aspect of the configuration of FIG. 8, wherein spreader body 194 is as discussed above positioned beneath claw arms 178 of claw structure 172. In this position, spreader body 194 also presents a wear surface between the claw arms and structure positioned beneath the claw arms, in this case a bushing 202 in which vane stem 160 is mounted.

Figure 11:
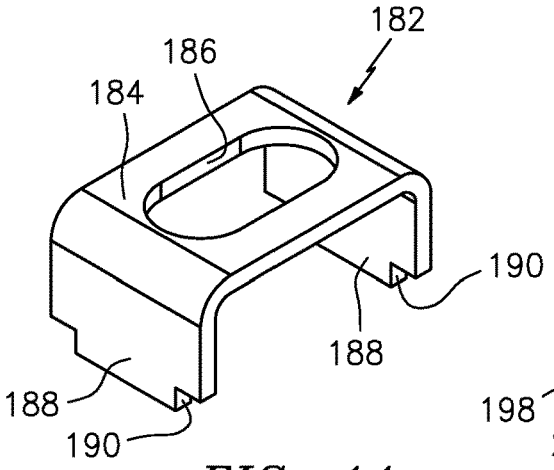
FIG. 11 illustrates a stamped sheet metal version of the load spreader of FIG. 6.
Figure 12:
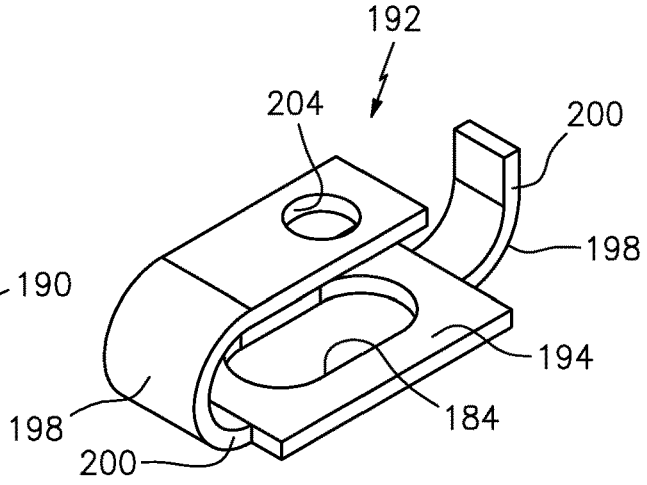
FIG. 12 illustrates a stamped sheet metal version of the load spreader of FIG. 8.

The configurations of FIGS. 6 and 8 show load spreaders 182, 192 which could be machined, additive manufactured or produced using any other known processes. It is also understood, however, that stamping from sheet metal is a particularly advantageous manufacturing method. FIGS. 11 and 12 illustrate embodiments wherein spreaders 182, 192 are made as stamped articles.

FIG. 11 shows a configuration corresponding to that of FIG. 6, wherein spreader 182 has a spreader body 184, an opening 186 and extensions 188 defining surfaces 190. As shown, however, these structures are all defined from a single sheet of metal, stamped to the desired shape and function.

FIG. 12 shows a configuration corresponding to that of FIG. 8, wherein spreader 192 has spreader body 194 defining opening 196 and having extensions 198 defining surfaces 200. Further, one extension 198 extends back to the central area to define an additional opening 204 which can receive round portion 168 of vane stem 160 to add even further stability to the connection. It should be appreciated that this configuration, like that of FIG. 11, can readily be manufactured by stamping of flat sheet metal, a process which can greatly reduce the cost of manufacture.

Figure 13:
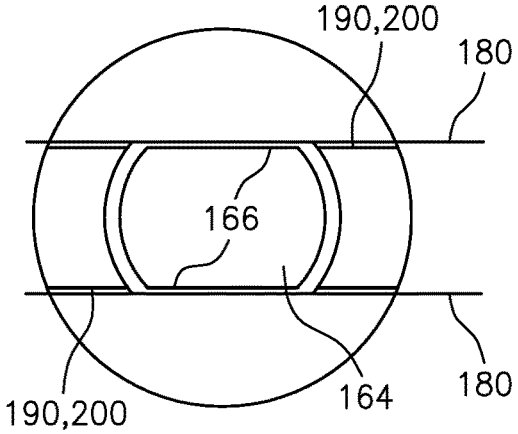
FIG. 13 illustrates expanded load bearing surfaces when utilizing a load spreader as disclosed herein.

FIG. 13 schematically illustrates the load spreading accomplished with load spreaders such as those disclosed herein. As shown, claw arm surfaces schematically illustrated at 180 would normally only have surfaces 166 of flatted head 164 to engage against (see also FIG. 5C). However, load spreader 182, 192 as disclosed herein presents surfaces 190, 200 which extend substantially parallel outwardly from surfaces 166 of flatted head 164, and between surfaces 180 of the claw arms, to extend the surface against which the claw can exert load and thereby distribute this load. FIG. 13 also again illustrates the space between surfaces 190, 200 and surface 180 when under a non-surge-load condition, so that during normal operation, the load spreader 182, 192 is not engaged.

Figure 14:
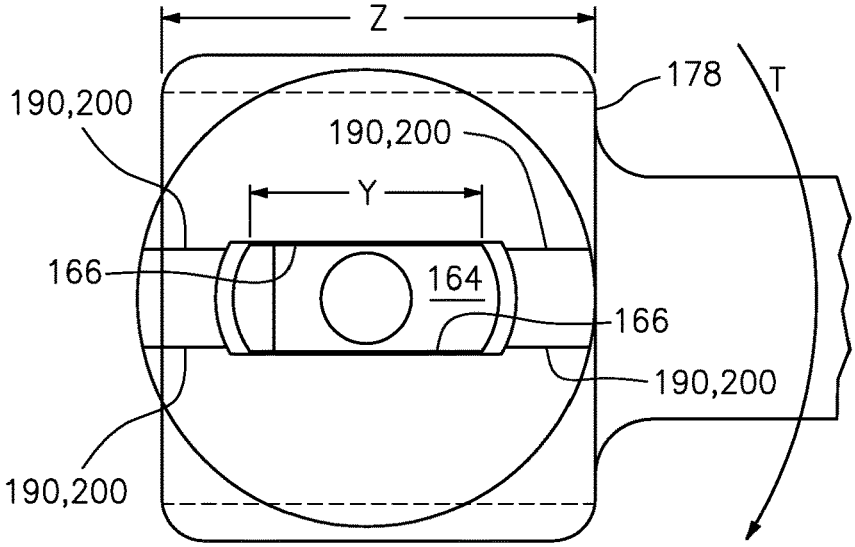
FIG. 14 illustrates distribution of load when using a load spreader as disclosed herein.

FIG. 14 also schematically illustrates load spreading accomplished with load spreaders as disclosed herein. FIG. 14 shows flatted head 164 with surfaces 166 engaged by claw arms 178. Contact without spreaders as disclosed herein would be only along width Y as shown in FIG. 14, with exertion of force only at the arrows shown within width Y. When such a structure is subjected to a surge load and resulting surge torque, the same width Y is subjected to the increased loads. However, utilizing spreaders 182, 192 as disclosed herein, surfaces 190, 200 are presented which extend the contact width to width Z as shown in FIG. 14, thereby greatly increasing the area or width to which surge torque is applied and distributed, and reducing the claw reaction loads by a ratio of approximately Y/Z.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason, the appended claims should be studied to determine true scope and content.

The invention claimed is:

1. A vane arm connection system for a gas turbine engine, comprising:

a vane stem having a flatted head;

a vane arm having a claw engaging the flatted head; and a load spreader having a spreader body defining structure engaging the flatted head, and at least one extension extending laterally from the spreader body, and wherein the flatted head is defined by laterally spaced flat surfaces on the vane stem, and wherein the claw defines inwardly facing edges for engaging the flat surfaces, and wherein the at least one extension extends between the inwardly facing surfaces of the claw.

2. The system of claim 1, wherein the at least one extension of the load spreader extends laterally substantially parallel to the laterally spaced flat surfaces of the flatted head for engaging with the inwardly facing edges of the claw.

3. The system of claim 2, wherein the at least one extension of the load spreader comprises two extensions extending opposite to each other.

4. The system of claim 1, wherein the claw has an upper surface defining an opening for engaging the vane stem and two claw arms extending downwardly from the upper surface and engaging the flatted head, wherein the spreader body is positioned between the upper surface and the claw arms, and wherein the at least one extension also extends downwardly into a space between the two claw arms.

5. The system of claim 1, wherein the claw has an upper surface defining an opening for engaging the vane stem and two claw arms extending downwardly from the upper surface and engaging the flatted head, wherein the spreader body is positioned below the claw arms, and wherein the at least one extension also extends upwardly into a space between the two claw arms.

6. The system of claim 5, wherein the spreader body defines a shelf extending radially outwardly from the vane stem, wherein the claw arms are held against disengaging from the vane stem.

7. The system of claim 5, wherein the spreader body defines a spacer between the claw arms and a shoulder of the vane stem.

8. The system of claim 5, wherein the spreader body defines a spacer between the claw arms and a bushing within which the vane stem is positioned.

9. The system of claim 1, wherein the laterally spaced flat surfaces on the vane stem are spaced from each other at a first width, and wherein the at least one extension defines oppositely facing parallel surfaces which are spaced at a second width, wherein the second width is less than the first width so that, under non-loaded conditions, the claw engages the flatted head and not the extension.

10. The system of claim 1, wherein the load spreader comprises stamped sheet metal defining the spreader body and the at least one extension.

11. The system of claim 10, wherein the spreader body has an opening which matches a shape of the flatted head, and downwardly curved ends defining the at least one extension.

12. The system of claim 10, wherein the spreader body has a first opening which matches a shape of the flatted head, upwardly curving ends defining the at least one extension, and a further spreader body portion extending from the at least one extension and defining a second opening for engaging the vane stem.

13. A method for retrofitting a vane arm having a vane arm claw to a vane stem having a flatted head, wherein the vane arm claw comprises claw arms for engaging the flatted head, comprising the step of positioning a load spreader on the vane stem, the load spreader comprising a spreader body defining structure engaging the flatted head, and at least one extension extending laterally from the spreader body, wherein the positioning step engages the spreader body with the flatted head with the extension between the claw arms.

14. The method of claim 13, wherein the vane arm claw is pre-loaded to contact with the flatted head, and spaced from contact with the at least one extension.

15. The method of claim 13, wherein the flatted head is defined by laterally spaced flat surfaces on the vane stem, and wherein the claw defines inwardly facing edges for engaging the flat surfaces, and wherein the extension extends between the inwardly facing edges of the claw.

16. A vane arm connection system for a gas turbine engine, comprising:

a vane stem having a flatted head;

a vane arm having a claw engaging the flatted head; and a load spreader having a spreader body defining structure engaging the flatted head, and at least one extension extending laterally from the spreader body, wherein the flatted head is defined by laterally spaced flat surfaces on the vane stem, and wherein the claw defines inwardly facing edges for engaging the flat surfaces, and wherein the laterally spaced flat surfaces on the vane stem are spaced from each other at a first width, and wherein the at least one extension defines oppositely facing parallel surfaces which are spaced at a second width, wherein the second width is less than the first width so that, under non-loaded conditions, the claw engages the flatted head and not the extension; and wherein the at least one extension extends between the inwardly facing edges of the claw.

* * * * *